US009098019B2

(12) United States Patent
Ishido

(10) Patent No.: US 9,098,019 B2
(45) Date of Patent: Aug. 4, 2015

(54) TONER REPLENISHMENT MECHANISM WITH SIMPLE CONSTITUTION, IMAGE FORMING APPARATUS WITH TONER REPLENISHMENT MECHANISM, AND TONER REPLENISHMENT CONTROL METHOD

(71) Applicant: KYOCERA Document Solutions Inc., Osaka (JP)

(72) Inventor: Kohei Ishido, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/562,207

(22) Filed: Dec. 5, 2014

(65) Prior Publication Data

US 2015/0185664 A1 Jul. 2, 2015

(30) Foreign Application Priority Data

Dec. 26, 2013 (JP) ..... 2013-268326

(51) Int. Cl.

| | |
|---|---|
| ***G03G 15/08*** | (2006.01) |
| ***G03G 21/16*** | (2006.01) |
| ***G03G 21/18*** | (2006.01) |

(52) U.S. Cl.

CPC ..... *G03G 15/0894* (2013.01); *G03G 15/0822* (2013.01); *G03G 15/0877* (2013.01); *G03G 15/0887* (2013.01); *G03G 21/1647* (2013.01); *G03G 21/1676* (2013.01); *G03G 21/1857* (2013.01); *G03G 2215/0802* (2013.01); *G03G 2221/163* (2013.01); *G03G 2221/1633* (2013.01); *G03G 2221/1657* (2013.01)

(58) Field of Classification Search

CPC ..... G03G 15/0822; G03G 15/0877; G03G 15/0887; G03G 15/0894; G03G 21/1647; G03G 21/1676; G03G 21/1857; G03G 2215/0802; G03G 2221/163; G03G 2221/1633; G03G 2221/1657

See application file for complete search history.

(56) References Cited

U.S. PATENT DOCUMENTS

| | | | | |
|---|---|---|---|---|
| 7,680,441 | B2 * | 3/2010 | Yoon | 399/228 |
| 2010/0189455 | A1 * | 7/2010 | Kim | 399/53 |
| 2012/0243914 | A1 * | 9/2012 | Yoshii et al. | 399/263 |
| 2014/0010561 | A1 * | 1/2014 | Kubo et al. | 399/53 |

FOREIGN PATENT DOCUMENTS

JP 2011-70091 A 4/2011

* cited by examiner

*Primary Examiner* — Ryan Walsh
(74) *Attorney, Agent, or Firm* — Stein IP, LLC

(57) ABSTRACT

A toner replenishment mechanism includes a motor, a first ratchet mechanical unit, and a second ratchet mechanical unit. The motor includes a rotation shaft with a pinion. The first ratchet mechanical unit engages the pinion. The first ratchet mechanical unit transmits only rotary drive power in a forward direction by the pinion to a driven mechanism disposed at a first toner replenishment unit. The first toner replenishment unit replenishes a first developer unit with a first color toner. The second ratchet mechanical unit engages the pinion. The second ratchet mechanical unit transmits only rotary drive power in a reverse direction by the pinion to a driven mechanism disposed at a second toner replenishment unit. The second toner replenishment unit replenishes a second developer unit with a second color toner.

13 Claims, 9 Drawing Sheets

FIG. 7

| Port logic | | Motor Operation |
|---|---|---|
| A | B | |
| H | H | – |
| H | L | Reverse Direction Rotation |
| L | H | Forward Direction Rotation |
| L | L | Brake |

TONER REPLENISHMENT MECHANISM WITH SIMPLE CONSTITUTION, IMAGE FORMING APPARATUS WITH TONER REPLENISHMENT MECHANISM, AND TONER REPLENISHMENT CONTROL METHOD

CROSS-REFERENCE TO RELATED APPLICATIONS

This application is based upon, and claims the benefit of priority from, corresponding Japanese Patent Application No. 2013-268326 filed in the Japan Patent Office on Dec. 26, 2013, the entire contents of which are incorporated herein by reference.

BACKGROUND OF THE INVENTION

Unless otherwise indicated herein, the description in this section is not prior art to the claims in this application and is not admitted to be prior art by inclusion in this section.

An image forming apparatus of an electrophotographic system performs a development process on an electrostatic latent image formed on a surface of an image carrier, such as a photoreceptor drum and an intermediate transfer belt, by supplying toner from a developer unit. The toner is housed in a toner container. When a toner density in the developer unit decreases, the toner container is driven by a motor for toner replenishment, and while the toner inside the toner container is stirred by a stir paddle, the toner is replenished to the developer unit by a transport screw.

In a color image forming apparatus, four colors of toner are used, and there are also four toner containers in total for respective colors. Therefore, when one motor for toner replenishment is mounted to the toner container of the respective colors, four motors are necessary and become a factor of cost increase. There is provided a conventional technique that locates a solenoid and a clutch mechanism in a toner replenishment apparatus. The toner replenishment apparatus can replenish toner to two or four developer units with one motor by switching of the clutch by ON/OFF control of the solenoid.

SUMMARY OF THE INVENTION

A toner replenishment mechanism according to an aspect of the disclosure includes a motor, a first ratchet mechanical unit, and a second ratchet mechanical unit. The motor includes a rotation shaft with a pinion. The first ratchet mechanical unit engages the pinion. The first ratchet mechanical unit transmits only rotary drive power in a forward direction by the pinion to a driven mechanism disposed at a first toner replenishment unit. The first toner replenishment unit replenishes a first developer unit with a first color toner. The second ratchet mechanical unit engages the pinion. The second ratchet mechanical unit transmits only rotary drive power in a reverse direction by the pinion to a driven mechanism disposed at a second toner replenishment unit. The second toner replenishment unit replenishes a second developer unit with a second color toner.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 7 illustrates port logics of a motor drive embodiment according to the one embodiment;

DETAILED DESCRIPTION OF THE EMBODIMENTS

Figure 1:
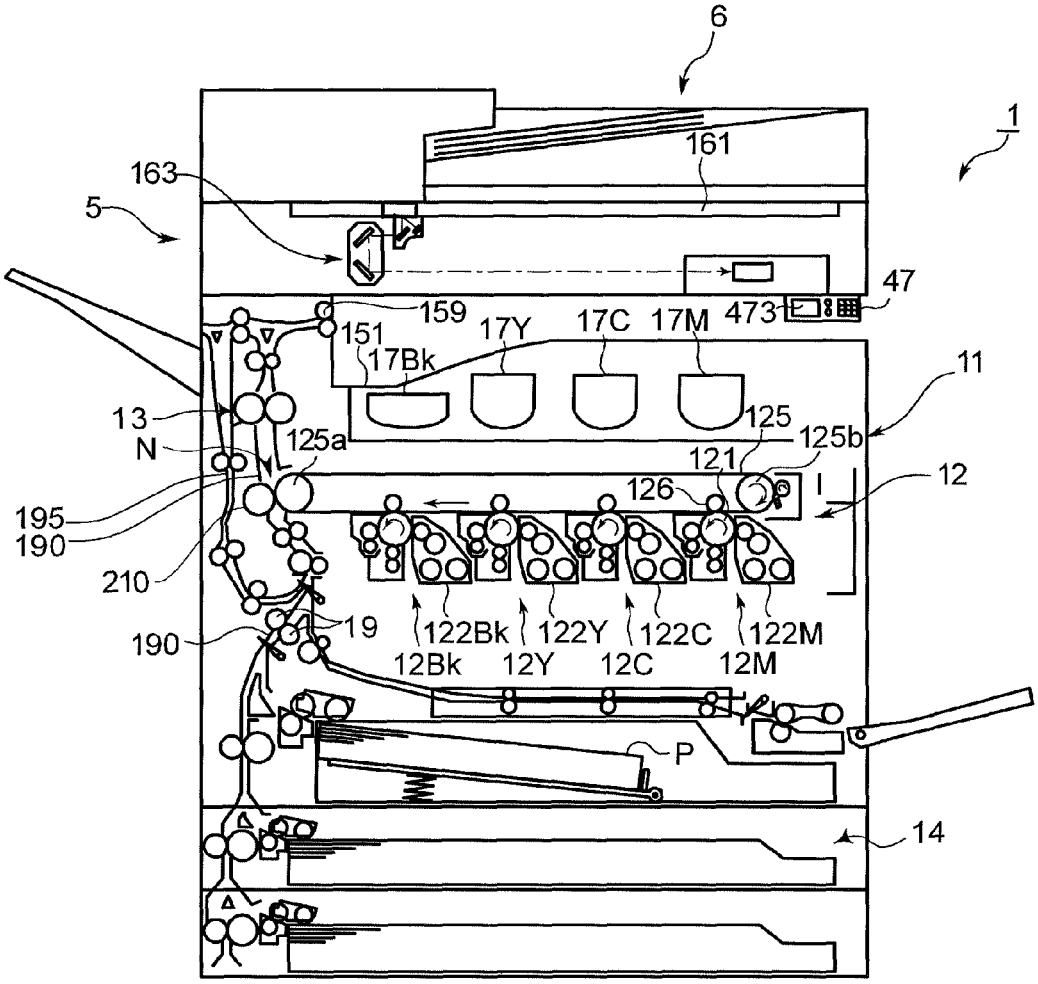
FIG. 1 illustrates a constitution of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus according to one embodiment of the disclosure with reference to drawings. FIG. 1 is a front cross-sectional view illustrating a constitution of an image forming apparatus according to the one embodiment of the disclosure.

An image forming apparatus 1 according to the one embodiment of the disclosure is a multi-functional peripheral with a plurality of functions, for example, such as a copying function, a printer function, a scanner function and a facsimile function. The image forming apparatus 1 includes an operation unit 47, an image forming unit 12, a fixing unit 13, a paper sheet feeder 14, a document feeding unit 6, and a document reading unit 5 and a similar unit in an apparatus main body 11.

The operation unit 47 accepts instructions such as an image forming operation execution instruction and a document reading operation execution instruction from an operator on various operations and processes executable by the image forming apparatus 1. The operation unit 47 includes a display unit 473. The display unit 473 is constituted with a Liquid Crystal Display (LCD) with a touch panel function.

When the image forming apparatus 1 performs a document reading operation, the processes such as the following are performed. The document reading unit 5 optically reads a document fed by the document feeding unit 6 or an image of the document placed on a document placing glass 161 and thus generates image data. The image data generated by the document reading unit 5 is stored in a built-in HDD, a network-connected computer or a similar medium.

When the image forming apparatus 1 performs an image forming operation, the processes such as the following are performed. The image forming unit 12 forms a toner image on a recording sheet P as a recording medium fed from the paper sheet feeder 14, based on the image data generated by the document reading operation described above, the image data received from the network-connected computer, the image data stored in the built-in HDD or similar data. In the color printing, the processes such as the following are performed. The image forming unit 12M for magenta, the image forming unit 12C for cyan, the image forming unit 12Y for yellow, and the image forming unit 12Bk for black of the image forming unit 12 each forms the toner image on the photoreceptor drum 121 through the processes of electrostatic charge, exposure, and development based on images that are formed of the respective color components and constitute the image data described above. The toner images are transferred on an intermediate transfer belt 125 by a primary transfer roller 126. The intermediate transfer belt 125 functions as an image carrier.

The toner images with the respective colors described above, which are transferred on the intermediate transfer belt 125, are superimposed on the intermediate transfer belt 125 with transfer timing adjusted, and become a color toner image. A secondary transfer roller 210 causes the color toner image formed on the surface of the intermediate transfer belt 125 to be transferred on the recording sheet P conveyed from the paper sheet feeder 14 through a conveyance path 190. The transfer is performed at a nip portion N where the intermediate transfer belt 125 is sandwiched by the secondary transfer roller 210 and a drive roller 125*a*. Thereafter, the fixing unit 13 causes the toner image on the recording sheet P to be fixed on the recording sheet P by thermocompression bonding. The color-image-formed recording sheet P to which the fixing process has completed is discharged to a discharge tray 151.

Further, in a duplex printing by the image forming apparatus 1, the processes such as the following are performed. The recording sheet P where the image is formed on one surface by the image forming unit 12 is set in the state nipped by a discharge roller pair 159. Thereafter, the recording sheet P is reversely fed and sent to an inverting conveyance path 195 by the discharge roller pair 159. Then the recording sheet P is conveyed again by a conveyance roller pair 19 to the upstream region in a conveyance direction of the recording sheet P with respect to the above-described nip portion N and the fixing unit 13. Thus, the image is formed on the other surface of the recording sheet P by the image forming unit 12.

A developer unit 122M in an image forming unit 12M, a developer unit 122C in an image forming unit 12C, a developer unit 122Y in an image forming unit 12Y, and a developer unit 122Bk in an image forming unit 12Bk perform a development process for each color, respectively.

At a position apart from these developer units 122M, 122C, 122Y, and 122Bk, specifically in a upper side across the intermediate transfer belt 125, a toner container 17M housing magenta toner, a toner container 17C housing cyan toner, a toner container 17Y housing yellow toner, and a toner container 17Bk housing black toner are removably mounted to a toner container mounting portion (not illustrated) located in the apparatus main body 11. When toner is used up, the respective toner containers 17M, 17C, 17Y, and 17Bk can be replaced as necessary by opening and closing a container cover (not illustrated) located in the apparatus main body 11.

A toner supply port is located in a bottom surface of the respective toner containers 17M, 17C, 17Y, and 17Bk. The toner supply port is connected to the inside of the respective developer units 122M, 122C, 122Y, and 122Bk via a pipe (not illustrated) installed approximately in a vertical posture to the apparatus main body 11. The toner supply port is closed by a rotating shutter (not illustrated) connected to a lever (not illustrated) in the state where the respective toner containers 17M, 17C, 17Y, and 17Bk are not mounted to the apparatus main body 11. Then, the toner supply port is constituted to be opened as follows: when the respective toner containers 17M, 17C, 17Y, and 17Bk is mounted to the apparatus main body 11, a lock of the lever is released, and then the shutter rotates in conjunction with a lever operation by a user. Additionally, instead of the rotating shutter, a sliding shutter that opens the toner supply port in conjunction with the mounting of the respective toner containers 17M, 17C, 17Y, and 17Bk to the apparatus main body 11 may be employed.

Inside the respective toner containers 17M, 17C, 17Y, and 17Bk, a transport screw (not illustrated) that conveys the toner up to a toner supply port is rotatably located The transport screw is rotatably driven by a motor and a gear mechanism for toner replenishment (not illustrated).

Figure 2:
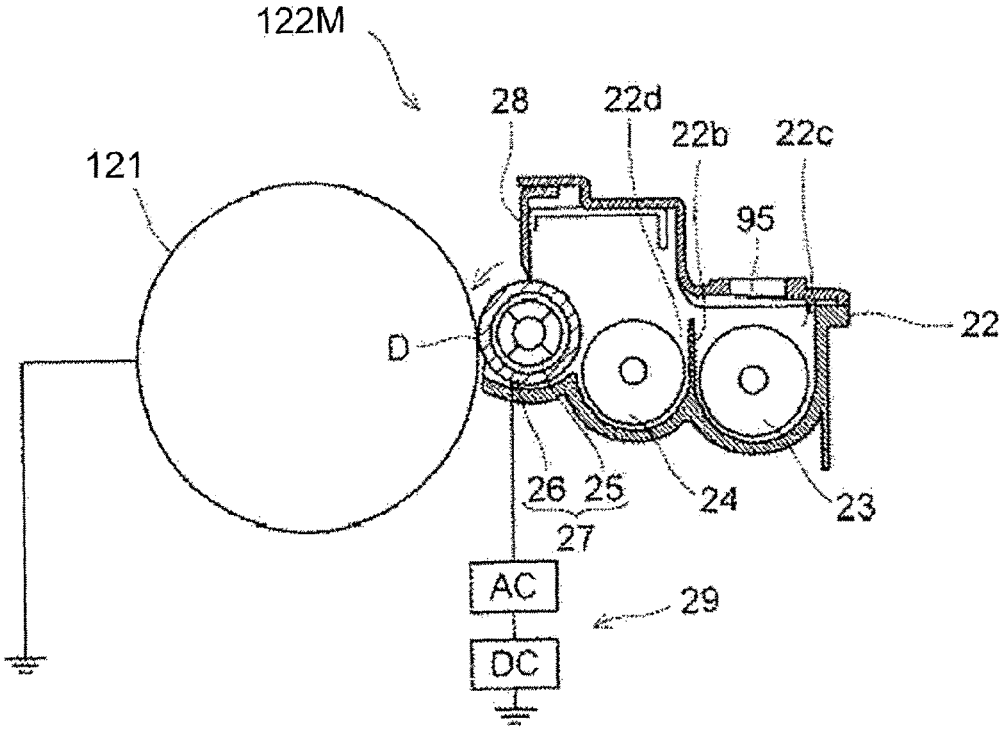
FIG. 2 illustrates a schematic constitution of a developer unit used for the image forming apparatus according to the one embodiment.
Figure 3:
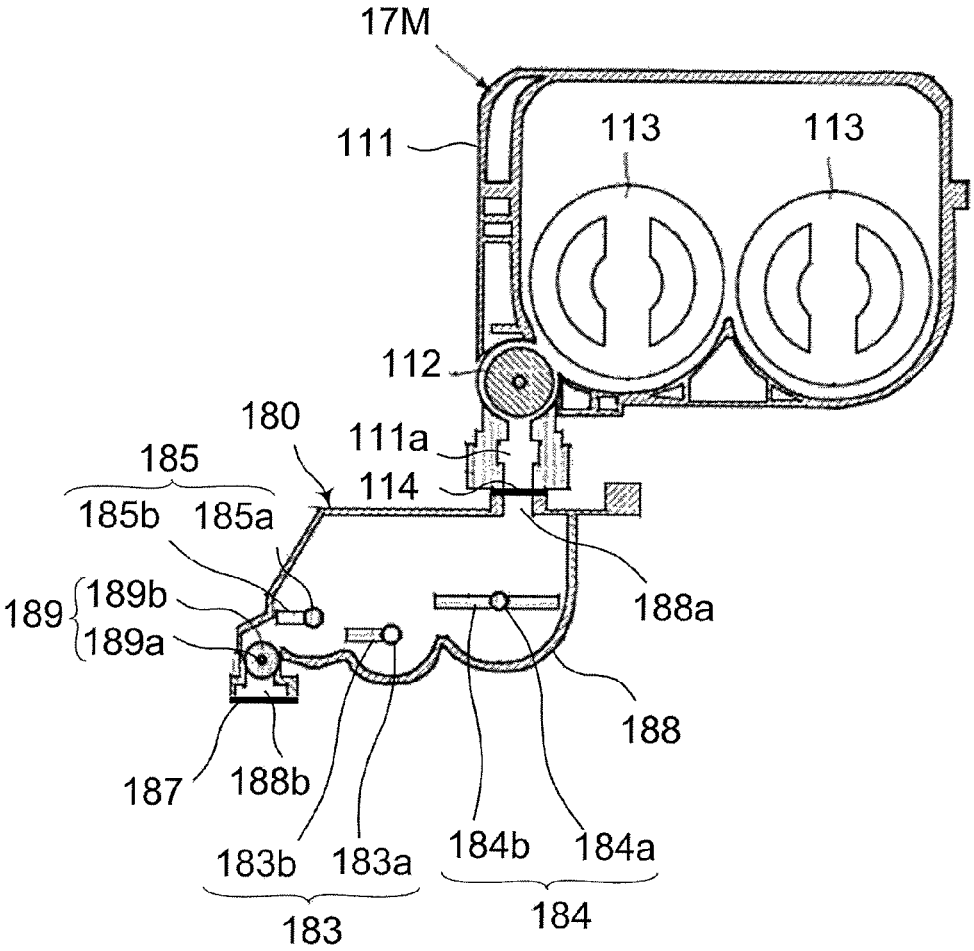
FIG. 3 illustrates a schematic constitution of an intermediate hopper and a toner container that supply toner to the developer unit according to the one embodiment.

Further, in the respective toner containers 17M, 17C, 17Y, and 17Bk, respectively, an intermediate hopper (see FIG. 2 and FIG. 3. Not illustrated in FIG. 1) is located to supply the toner to the developer units 122M, 122C, 122Y, and 122Bk. The intermediate hopper receives toner from any one of the corresponding toner containers 17M, 17C, 17Y, and 17Bk and supplies toner to the developer units 122M, 122C, 122Y, and 122Bk. Additionally, in this embodiment, a relatively large-sized image forming apparatus with the intermediate hopper is described as an example.

However, application of a toner replenishment mechanism according to the disclosure is not limited to the application to the image forming apparatus with the intermediate hopper. The type of an image forming apparatus where, without the intermediate hopper, toner is supplied to a developer unit from a toner container can also be applicable.

Next, the developer unit 122M will be described based on FIG. 2. FIG. 2 is a cross-sectional side view illustrating a schematic constitution of the developer unit 122M used for the image forming apparatus 1. The description of the developer units 122C, 122Y, and 122Bk will be omitted because of their similar constitutions to the developer unit 122M. Thus, the following describes the constitution of the developer unit 122M.

The developer unit 122M includes a developing container 22 housing toner, stirring screws 23 and 24 stirring the toner, a development roller 27, and a regulating member 28.

The stirring screws 23 and 24 are rotatably located inside the developing container 22 and supply the toner to the development roller 27 by stirring and circulating the toner.

The development roller 27 includes a fixed magnet body 25 and a development sleeve 26. The development sleeve 26 is constituted of a cylindrically-shaped non-magnetic material and is rotatably supported at a position adjacent to the stirring screw 24 in the developing container 22. The fixed magnet body 25 is constituted of a permanent magnet fixed inside the development sleeve 26 and generates magnetic fields toward the development sleeve 26. Furthermore, the development roller 27 is exposed from an opening of the developing container 22 and faces to a photoreceptor drum 121 being the image carrier at a certain distance. The facing region is a developing region D where the toner carried on the development sleeve 26 is supplied toward the photoreceptor drum 121. Further, a developing bias 29 where alternating current is superimposed on direct current are applied to the development sleeve 26 for the supply of the toner to the photoreceptor drum 121.

The regulating member 28 regulates the toner carried on the surface of the development sleeve 26 to a predetermined layer thickness. The regulating member 28 is mounted to the developing container 22 approximately above of the development sleeve 26 at a predetermined distance from a surface of the development sleeve 26.

By magnetic force of the fixed magnet body 25 inside the development sleeve 26, the toner supplied from the stirring screw 24 is carried on the surface of the development sleeve 26. The carried toner is regulated to the predetermined layer thickness by the regulating member 28. The carried toner is conveyed toward the developing region D by the rotation (the rotation in an arrow direction in FIG. 2) of the development sleeve 26. By the application of the developing bias 29 to the development sleeve 26, an electric potential difference is generated between the development sleeve 26 and photoreceptor drum 121 in the developing region D. Thus, the toner on the development sleeve 26 is supplied to the photoreceptor drum 121, and an electrostatic latent image on the photoreceptor drum 121 is developed into the toner image.

A toner replenishing port 95 is located in the upper portion of the developing container 22. When the toner inside the developing container 22 is reduced by consumption, new toner is supplied to the inside of the developing container 22 from the intermediate hopper (FIG. 3) via the toner replenishing port 95. Further, at the proximity of the toner replenishing port 95, a development side joint (not illustrated) is located. The development side joint engages with a joint of the intermediate hopper side, which will be described later and rotates the joint of the intermediate hopper side.

Next, the intermediate hopper will be described based on FIG. 3. FIG. 3 is a cross-sectional side view illustrating a schematic constitution of the intermediate hopper and the toner container that supply toner to the developer unit 122M. Because the constitutions around the developer units 122C, 122Y, and 122Bk are similar to the constitution around the developer unit 122M, the constitution around the developer unit 122M will be described as an example here too.

The toner container 17M includes a container vessel 111 retaining unused toner, a replenishing port 111*a*, a shutter member 114 switching an open or closed state of the replenishing port 111*a*, a container screw (transport screw) 112, and a stir paddle 113. In addition, the toner container 17M is removably mounted with respect to an intermediate hopper 180.

The replenishing port 111*a* is formed at one end portion in the longitudinal direction and in a bottom portion of the container vessel 111, and supplies the toner to the intermediate hopper 180.

The stir paddle 113 extends both sides in a radial direction from the shaft portion of the stir paddle 113 and is a paddle-shaped blade expanded in the longitudinal direction of the vessel. The stir paddle 113 stirs the toner inside the container vessel 111 by the rotation of the paddle-shaped blade.

A container screw 112 is located in the bottom portion inside the container vessel 111 and is formed in a spiral pattern with a constant pitch in the longitudinal direction around a shaft portion facing the replenishing port 111*a*. When the container screw 112 rotates around the shaft portion, the stirred toner is conveyed toward the replenishing port 111*a*. Then, when the shutter member 114 covering the replenishing port 111*a* opens the replenishing port 111*a*, the toner inside the container vessel 111 is supplied to the intermediate hopper 180 via the replenishing port 111*a*.

When the toner is supplied to the intermediate hopper 180 from the toner container 17M and the toner inside the container vessel 111 is used up, the toner container 17M is removed from the intermediate hopper 180 and new toner container 17M filled with the toner is mounted to the intermediate hopper 180.

The intermediate hopper 180 includes a hopper container 188 retaining the toner, a receiving port 188*a*, a delivering port 188*b*, a shutter member 187 switching the open or closed state of the delivering port 188*b*, a conveyance member 189, and a first, a second, and a third stirring members 183, 184, and 185.

The receiving port 188*a* is formed at the position facing the replenishing port 111*a* of the toner container 17M in the upper portion of the hopper container 188.

The delivering port 188*b* is formed in the bottom portion of the hopper container 188 and faces the toner replenishing port 95 (see FIG. 2) of the developer unit 122M.

The conveyance member 189 includes a shaft portion 189*a* and a spiral blade 189*b*. The conveyance member 189 is located facing the delivering port 188*b* in the bottom portion of the hopper container 188. The shaft portion 189*a* is rotatably supported by both sidewalls of the hopper container 188. The spiral blade 189*b* is formed in a spiral pattern with a constant pitch in the peripheral area of the shaft portion 189*a*. When the spiral blade 189*b* rotates around the shaft portion 189*a*, the stirred toner is conveyed toward the delivering port 188*b*.

A first stirring member 183 includes a first shaft portion 183*a* and a first blade 183*b*. The first shaft portion 183*a* is rotatably supported by both sidewalls of the hopper container 188. The first blade 183*b* extends to one side in a radial direction from the first shaft portion 183*a* but the length of it is short. Further, the first blade 183*b* expands in the longitudinal direction of the container, and its distal end portion is formed in a curved paddle shape. When the first blade 183*b* rotates around the first shaft portion 183*a*, a small amount toner is stirred.

The second stirring member 184 includes a second shaft portion 184*a* and a second blade 184*b*. The second shaft portion 184*a* is rotatably supported by both sidewalls of the hopper container 188. The second blade 184*b* extends to one side in a radial direction from the second shaft portion 184*a* and the length of it is comparatively long. Further, the second blade 184*b* expands in the longitudinal direction of the container, and its distal end portion is formed in a curved paddle shape. Additionally, the second blade 184*b* is curved in the reverse direction compared to the first blade 183*b* of the first stirring member 183 in a circumferential direction. When the second blade 184*b* rotates around the second shaft portion 184*a*, a large amount of toner is stirred.

The third stirring member 185 includes a third shaft portion 185*a* and a third blade 185*b*. The third shaft portion 185*a* is rotatably supported by both sidewalls of the hopper container 188. The third blade 185*b* extends to one side in a radial direction from the third shaft portion 185*a* and expands in the longitudinal direction of the container with its distal end portion formed in a curved paddle shape. When the third blade 185*b* rotates around the third shaft portion 185*a*, the toner is stirred.

Further, each shaft portion of the first, the second, and the third stirring members 183, 184, and 185, and the conveyance member 189 are arranged in parallel in a front and back direction of the paper in FIG. 3.

The second stirring member 184 is located in an approximately lower side of the receiving port 188*a* inside the hopper container 188. Thus, the toner falls onto the second stirring member 184 from the receiving port 188*a*. Then, the second stirring member 184 stirs the fallen toner and conveys the stirred toner to the first stirring member 183 side.

The first stirring member 183 and the third stirring member 185 are located in the left side of the second stirring member 184. The first stirring member 183 and the third stirring member 185 are located facing to the conveyance member 189 in an approximately upper side of the conveyance member 189. The first stirring member 183 stirs the toner conveyed from the second stirring member 184. Further, the third stirring member 185 stirs the toner conveyed from the first stirring member 183, and the toner is conveyed to the conveyance member 189 side.

The shutter member 187 opens and closes the delivering port 188*b*. The shutter member 187 is normally closed and covers the delivering port 188*b*. When the toner is supplied to the developer unit 122M from the hopper container 188, the shutter member 187 moves in the longitudinal direction of the container and opens the delivering port 188*b*.

Figure 4:
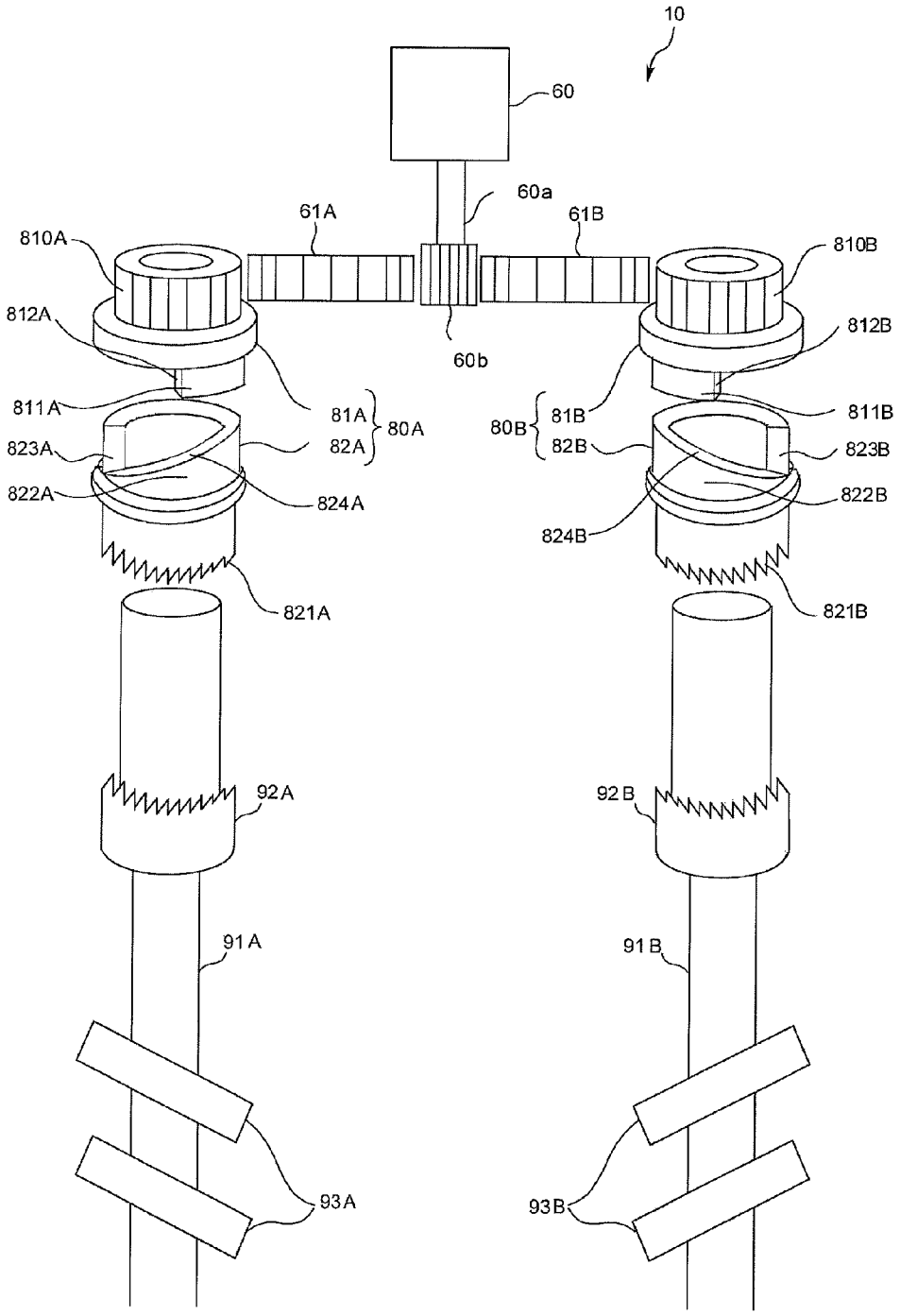
FIG. 4 illustrates the constitution of a toner replenishment mechanism according to the one embodiment.

FIG. 4 illustrates a constitution of the toner replenishment mechanism. A toner replenishment mechanism 10 individually replenishes toner to two developer units by one motor 60 for toner replenishment. The toner replenishment mechanism 10 transmits driving power of the motor 60 from the toner containers 17M and 17C as one example of a toner replenishment unit to the developer units 122M and 122C.

In addition, the toner replenishment mechanism 10 is located as a mechanism that transmits the driving power of the motor 60 from the toner containers 17Y and 17Bk as one example of the toner replenishment unit to the developer units 122Y and 122Bk.

Namely, in the image forming apparatus 1, two toner replenishment mechanisms 10 are mounted. For example, one toner replenishment mechanism replenishes magenta toner and cyan toner to the developer units 122M and 122C respectively. The other one toner replenishment mechanism replenishes yellow toner and black toner to the developer units 122Y and 122Bk respectively. FIG. 4 illustrates the mechanism of the toner containers 17M and 17C side as one of the two toner replenishment mechanisms 10.

The toner replenishment mechanism 10 includes the motor 60, gears 61A and 61B, and ratchet mechanism units 80A and 80B. The ratchet mechanism unit 80A is mounted to the toner container 17M. The ratchet mechanism unit 80B is mounted to the toner container 17C.

The motor 60 is, for example, a DC brush motor and generates rotary drive power when DC current is energized. A pinion 60*b* is mounted to a rotation shaft 60*a* of the motor 60.

The pinion 60*b* engages with the gears 61A and 61B. The gear 61A engages with the ratchet mechanism unit 80A, and the gear 61B engages with the ratchet mechanism unit 80B. When the motor 60 rotates, the rotary drive power is transmitted to the ratchet mechanism units 80A and 80B. The gears 61A and 61B are located to cause the rotary drive power of the motor 60 to transmit to the ratchet mechanism units 80A and 80B that are physically apart from the motor 60, and are constituted of one or a plurality of gears.

The ratchet mechanism unit 80A includes a first member 81A and a second member 82A. A gear 810A of the first member 81A of the ratchet mechanism unit 80A engages with the gear 61A. The second member 82A rotates by engaging with the first member 81A in the direction perpendicular to an arranging direction of the pinion 60*b* and the first member 81A with respect to the first member 81A.

In the lower portion of the first member 81A of the ratchet mechanism unit 80A, that is, in the portion that faces the second member 82A, an engaging end portion 812A, which engages with the second member 82A is located. Furthermore, in the upper portion of the second member 82A, that is, in the portion that faces the first member 81A, an engaging portion 822A and an engaging end portion 823A formed by the notch of a part of the engaging portion 822A are located. The engaging end portion 812A of an engaging portion 811A has a shape similar to the engaging end portion 823A and can be in facially close contact with the engaging end portion 823A. On the other hand, a sliding end portion 824A of the engaging portion 822A is formed to have a gentle slope and to be impossible to engage with the engaging portion 811A. Namely, the engaging end portion 812A can abut on the engaging end portion 823A in the direction of the transmission of the rotary drive power. However, the sliding end portion 824A does not abut on the sliding end portion 824A in the direction where the rotary drive power is not transmitted.

Thus, when the pinion 60*b* of the motor 60 rotates in the forward direction, and, by the engagement of the gear 61A and the gear 810A, the first member 81A of the ratchet mechanism unit 80A rotates only in the corresponding direction (in this embodiment, the direction is also referred to as the forward direction), the engaging end portion 812A of the first member 81A engages with the engaging end portion 823A, which is the notched portion of the second member 82A. This engagement enables the first member 81A to transmit the rotary drive power of the motor 60 to the second member 82A.

In the first member 81A and second member 82A, a shaft 91A is inserted so as to freely fit respectively. The second member 82A has a crown gear 821A. The second member 82A is set in a state where the second member 82A engages with a crown gear 92A located in the shaft 91A. In this embodiment, an example where the container screw 112 of the toner container 17M is mounted to the shaft 91A will be described.

However, a member to be mounted in the shaft 91A, namely, a member that is mounted to the shaft 91A and is a driven member by the toner replenishment mechanism 10 is not limited to the container screw 112. For example, in the toner container, the members such as the stir paddle 113 and shutter member 114 of the toner container 17M are the driven members by the toner replenishment mechanism 10.

Furthermore, the intermediate hopper 180 is also a drive target by the toner replenishment mechanism 10. For example, the shutter member 187, the conveyance member 189, the first stirring member 183, the second stirring member 184 and a similar member of the intermediate hopper 180 are the driven member by the toner replenishment mechanism 10.

By the engagement of the crown gear 821A and 92A, the rotary drive power of the second member 82A is transmitted to the shaft 91A. Thus, with the rotation of the shaft 91A, the container screw 112 rotates, and the toner is replenished from the toner container 17M to the developer unit 122M.

On the other hand, when the pinion 60*b* of the motor 60 rotates in the reverse direction (the opposite direction to the forward direction described above), by the engagement of the gear 810A and the gear 61A, the first member 81A of the ratchet mechanism unit 80A rotates in the corresponding direction (in this embodiment, the direction is also referred to as the reverse direction). In this case, the engaging end portion 812A of the first member 81A does not engage with the engaging end portion 823A of the second member 82A. Therefore, the rotary drive power of the first member 81A is not transmitted to the second member 82A, and thus the second member 82A is not rotatably driven. In view of this, when the pinion 60*b* of the motor 60 rotates in the reverse direction, the shaft 91A does not rotates, and thus the container screw 112 does not rotates. As a result of this, the toner is not replenished to the developer unit 122M from the toner container 17M.

Additionally, the ratchet mechanism unit 80B includes a first member 81B and a second member 82B where the constitutions are similar to the first member 81A and the second member 82A of the ratchet mechanism unit 80A. Each portion of the first member 81B and the second member 82B indicated by the replacement of a sign A, which is attached to each portion of the first member 81A and the second member 82A, to a sign B has similar constitution to the first member 81A and the second member 82A.

However, in the first member 81B and the second member 82B of the ratchet mechanism unit 80B, when the pinion 60*b* of the motor 60 rotates in the reverse direction (the opposite direction to the forward direction described above), and, by the engagement of a gear 810B and the gear 61B, the first member 81B of the ratchet mechanism unit 80B rotates in the corresponding direction (in this embodiment, this direction is also referred to the reverse direction). Only in this case, an engaging portion 812B of the first member 81B engages with an engaging end portion 823B of the second member 82B. By this engagement, the rotary drive power of the motor 60 is transmitted to the second member 82B from the first member 81B only when the pinion 60*b* of the motor 60 rotates in the reverse direction. Thus, with the rotation of a shaft 91B, the container screw 112 rotates, and the toner is replenished to the developer unit 122C from the toner container 17C.

Figure 5:
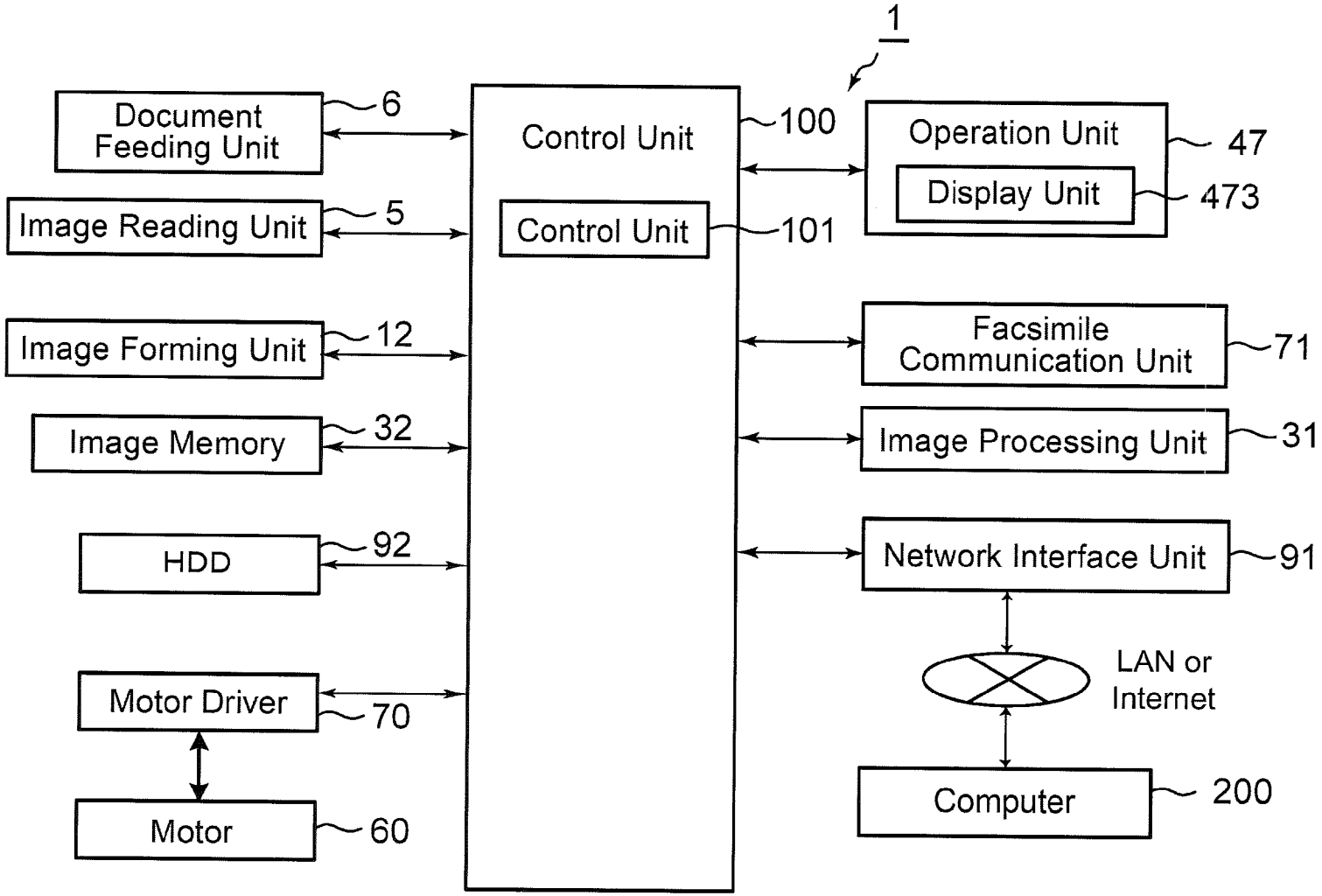
FIG. 5 illustrates a main internal configuration of the image forming apparatus according to the one embodiment.

Next, the constitution of the image forming apparatus 1 will be described. FIG. 5 illustrates a main internal constitution of the image forming apparatus 1.

The image forming apparatus 1 includes a control unit 100. The control unit 100 is constituted with a Central Processing Unit (CPU), a RAM, a ROM, an exclusive hardware circuit and similar components (not illustrated) and manages the whole operation control of the image forming apparatus 1.

The document reading unit 5, under control by the control unit 100, includes a reading mechanism 163 with a light irradiation unit, a CCD sensor, and a similar component. The document reading unit 5 irradiates a document by the light irradiation unit and reads the image from the document by receiving reflected light with the CCD sensor.

An image processing unit 31 performs image processing to image data of the image read by the document reading unit 5 as necessary. For example, the image processing unit 31 performs predetermined image processing such as shading correction to improve the quality of the image after the image read by the document reading unit 5 underwent image formation by the image forming unit 12.

An image memory 32 is a region where data of the document image obtained by the reading by the document reading unit 5 is temporarily stored, or data to be a printing object of the image forming unit 12 is temporarily saved.

The image forming unit 12 performs image formation to print data read by the document reading unit 5, print data received from a network-connected computer 200, and similar print data.

The operation unit 47 accepts the instructions from the operator on the various operations and processes executable by the image forming apparatus 1. The operation unit 47 includes the display unit 473.

The display unit 473 performs various displays such as an operation screen, a preview screen, a confirmation screen of print job conditions when the image forming apparatus 1 is in the ordinary operation mode. On the other hand, the display unit 473 is turned off when the image forming apparatus 1 is in sleep mode.

A facsimile communication unit 71 includes an encoding/decoding unit, a modulation and demodulation unit, and Network Control Unit (NCU) (not illustrated) and performs facsimile transmission with the use of dial-up line network.

A network interface unit 91 is constituted with communication module such as LAN board. The network interface unit 91 performs transmission and reception of various data with computers such as the computer 200 inside a local area via LAN or similar network connected to the network interface unit 91.

A HDD 92 is a large capacity storage device storing the document images read by the document reading unit 5 or similar data.

The motor 60 is a driving source to drive the respective toner containers 17M, 17C, 17Y, and 17Bk. As described above, one motor 60 drives two toner containers.

A motor driver 70 is an electrical circuit that rotatably drives the motor 60 by supplying current to the motor 60.

A controller 101 is connected to the document reading unit 5, the document feeding unit 6, the image processing unit 31, the image memory 32, the image forming unit 12, the operation unit 47, the facsimile communication unit 71, the network interface unit 91, the Hard Disk Drive (HDD) 92, the motor driver 70 and similar units, and performs drive control of these respective units.

Figure 6:
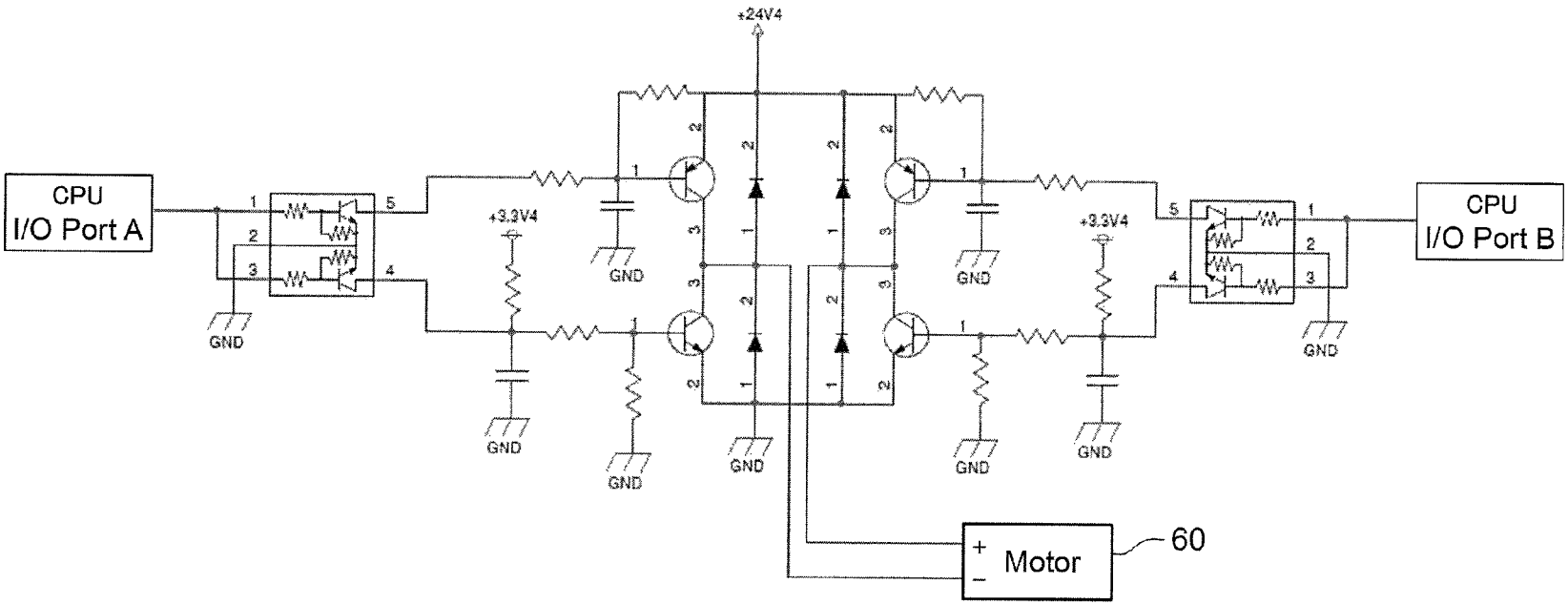
FIG. 6 illustrates a circuit of a motor driver according to the one embodiment.

FIG. 6 is a circuit diagram of the motor driver 70. As illustrated in FIG. 6, the motor driver 70 is constituted with, for example, an H-bridge circuit As illustrated in FIG. 7, the controller 101 controls output logical values of I/O ports A and B and controls the rotation direction of the motor 60 by the energization or non-energization and switching of a energization direction of the motor 60.

Figure 8:
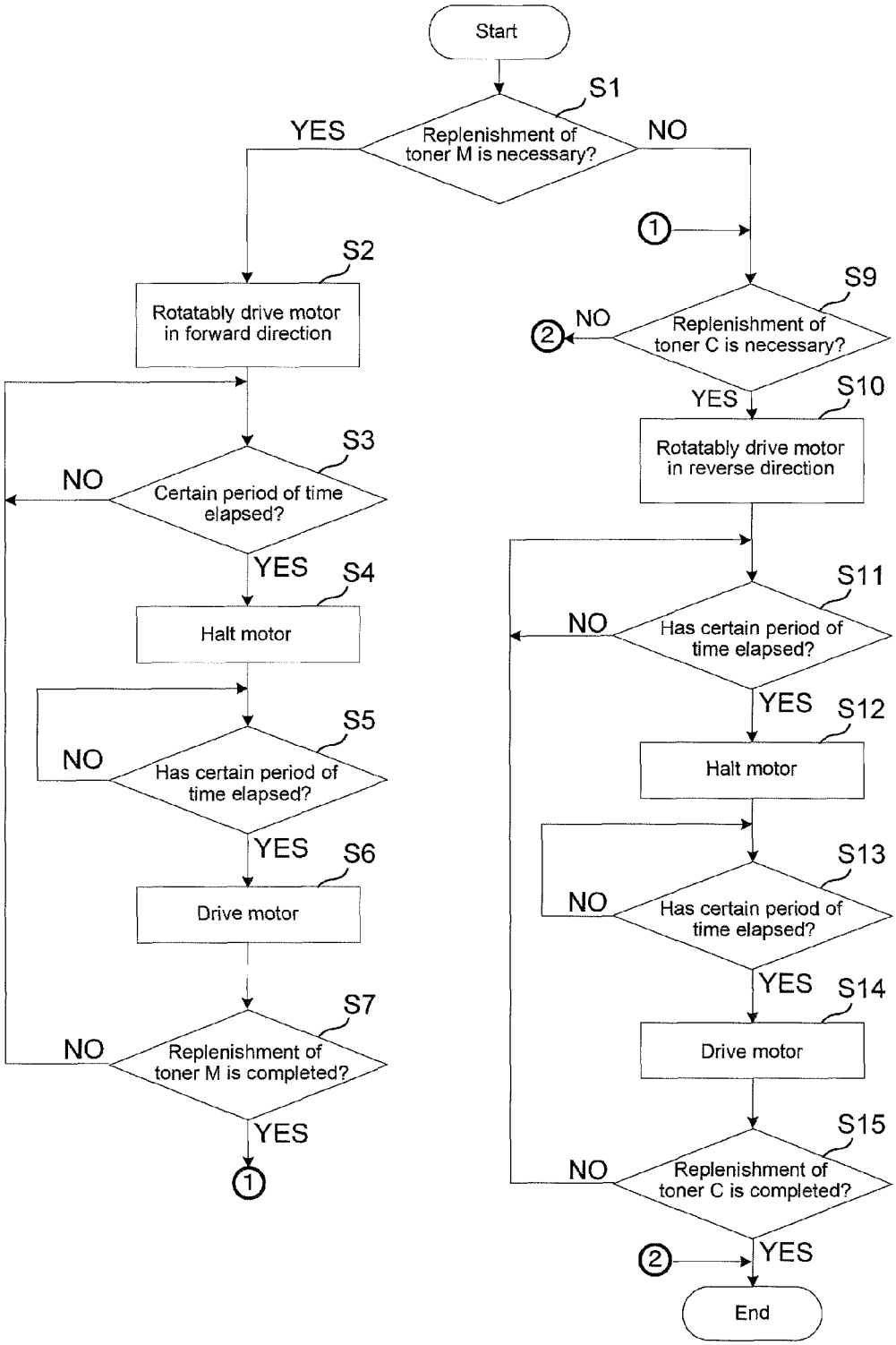
FIG. 8 illustrates a first configuration of toner replenishment in the image forming apparatus according to the one embodiment.

Next, a first embodiment of the toner replenishment in the image forming apparatus 1 will be described. FIG. 8 is a flowchart illustrating the first embodiment of the toner replenishment in the image forming apparatus 1. For convenience, an example where magenta toner (toner M) and cyan toner (the toner C) are replenished by the toner replenishment mechanism illustrated in FIG. 4 will be described. The description of the replenishment of yellow toner and black toner will be omitted. However, the replenishment for them is similar to that of magenta toner (the toner M) and cyan toner (the toner C).

First, the controller 101 determines whether or not replenishment of toner M is necessary (Step S1). Then, when the controller 101 determines that the replenishment of the toner M is necessary (YES in Step 51), the controller 101 outputs a control signal to the motor driver 70 by setting an output of a port A "H" and an output of a port B "L," and rotatably drives the motor 60 in the forward direction (Step S2). Then, when the controller 101 determines that the motor 60 was driven for a certain period of time (for example, one second) based on a time measured by a built-in timer or a similar timer in the control unit 100 (YES in Step S3), the controller 101 causes the rotation of the motor 60 to halt by setting both of the ports A and B "L" (Step S4).

Afterwards, when a certain period of time (for example, one second) elapsed (YES in Step S5), the controller 101 sets the output of the port A "H" and the port B "L" and rotatably drives the motor 60 again in the forward direction (Step S6). The controller 101 repeats the processes from Step S3 to S6 until the controller 101 determines that the toner replenishment of the toner M is completed (NO in Step S7).

The reason why an intermittent drive control is performed to the motor 60 as described above is that continuous driving of the motor 60 causes the toner to fall in the developer unit 122M in a bunch. This phenomenon causes density difference of the toner, toner fog, and a similar defect to occur. In addition, the toner fog is the phenomenon that toner overflows from a developer unit and appears in an image.

When the controller 101 determines that the toner replenishment of the toner M is completed (YES in Step S7) or determines that the replenishment of the toner Y is not necessary in S1 (NO in Step S1), the controller 101 determines whether or not the replenishment of a toner C is necessary (Step S9). When the controller 101 determines that the replenishment of the toner C is necessary (YES in Step S9), the controller 101 outputs the control signal to the motor driver 70 by setting the output of the port A "L" and the output of the port B "H" and rotatably drives the motor 60 in the reverse direction (Step S10).

Then, when the controller 101 determines that the motor 60 was driven for a certain period of time (for example, one second) based on a time measured by a built-in timer or a similar timer in the control unit 100 (YES in Step S11), the controller 101 causes the rotation of the motor 60 to halt by setting both outputs of the ports A and B "L" (Step S12).

Afterwards, when a certain period of time (for example, one second) elapsed (YES in Step S13), the controller 101 sets the output of the port A "L" and the port B "H" and rotatably drives the motor 60 again in the reverse direction (Step S14). The controller 101 repeats the processes from Step S10 to S14 until the controller 101 determines that the toner replenishment of the toner C is completed (NO in Step S15). Then, when the controller 101 determines that the toner replenishment of the toner C is completed (YES in Step S15), the controller 101 terminates the process. By a sequential operation described above, the replenishment of the toner M and toner C is completed.

As described above, in the first embodiment, with the above-described ratchet mechanism unit, the rotation drive control of the one motor 60 can cause the toner replenishment operation by the two toner containers, which perform opposing operation with each other, to perform respectively and individually on whether or not to perform the toner replenishment. Thus, with the relatively small number of components instead of the use of many components such as solenoids or clutch mechanisms, the toner replenishment mechanism where the toner is replenished individually to two developer units with one motor 60 for the toner replenishment can be constituted. This ensures that the cost of the toner replenishment mechanism is reduced, and further the cost of the image forming apparatus 1 is reduced.

Figure 9:
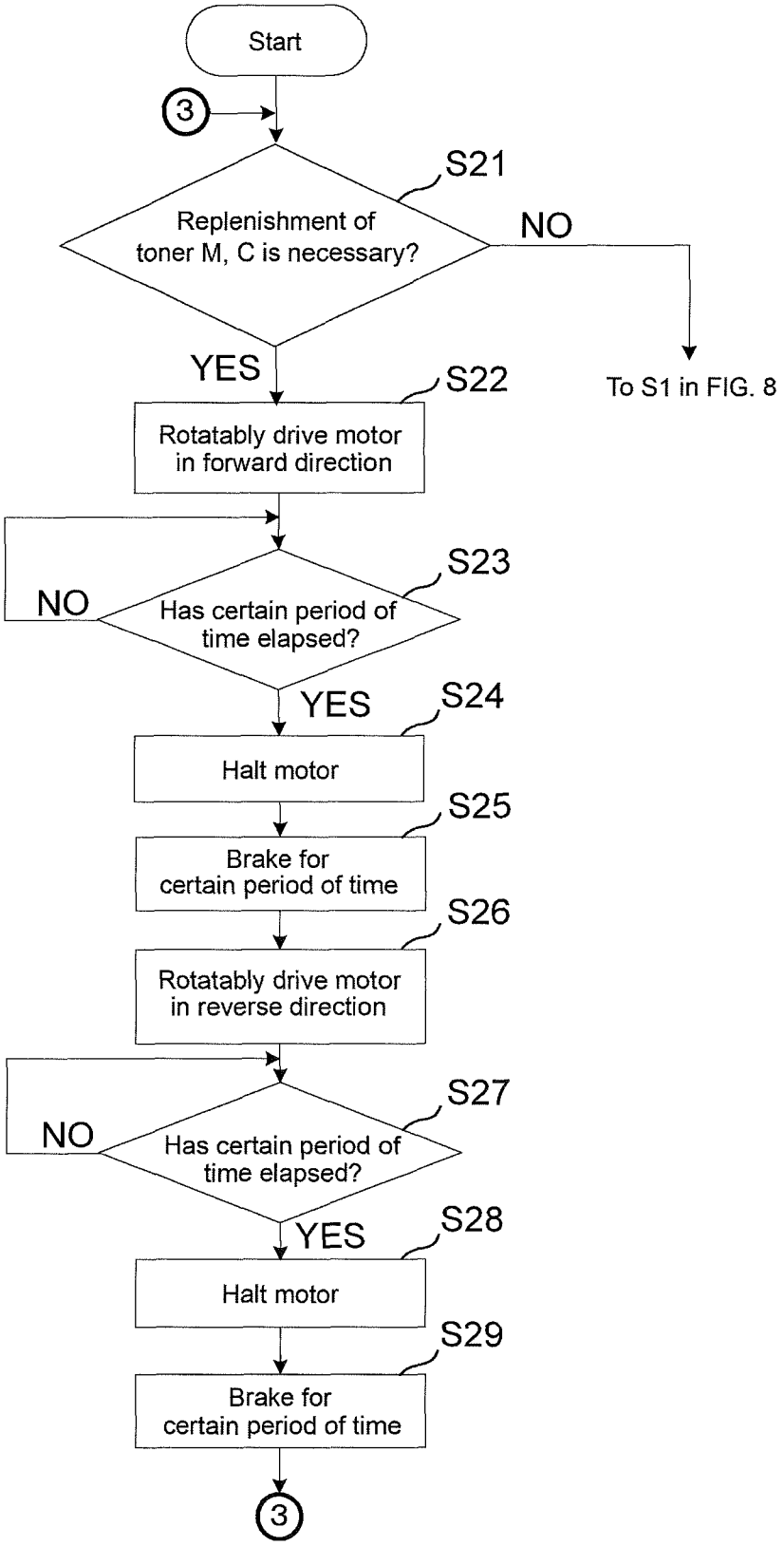
FIG. 9 illustrates a second configuration of the toner replenishment in the image forming apparatus according to the one embodiment.

Next, a second embodiment of the toner replenishment in the image forming apparatus 1 will be described. FIG. 9 illustrates the second embodiment of the toner replenishment in the image forming apparatus 1. The second embodiment shows a form where the toner replenishment mechanism 10 performs substantially simultaneously the toner replenishment to both toner containers 17M and 17C being objects of the toner replenishment by the toner replenishment mechanism 10.

In the second embodiment, first, the controller 101 determines whether or not the toner replenishment for both of the toner M and toner C is necessary. Then, when the controller 101 determines that the replenishment for both of the toner M and toner C is necessary (YES in Step S21), the controller 101 outputs the control signal to the motor driver 70 by setting the output of the port A "H" and the output of the port B "L" and rotatably drives the motor 60 in the forward direction (Step S22). Namely, first, the toner replenishment for the toner container 17M side is performed. However, the toner replenishment for the toner container 17C side may be first started.

Additionally, when the controller 101 determines that the replenishment is not necessary for both of the toner M and toner C (NO in Step S21), the following processes from S21 to S29 are not performed. In this case, the process may proceed to S1 illustrated in FIG. 8.

Then, when the controller 101 determines that the motor 60 was driven for a certain period of time (for example, one second) based on a time measured by a built-in timer or a similar timer in the control unit 100 (YES in Step S23), the controller 101 cause the rotation of the motor 60 to halt by setting both outputs of the ports A and B "L" (Step S24).

Afterwards, the controller 101 maintains a state where the rotation of the motor 60 is halted (brake) only for a certain period of time (for example, 0.5 second) by setting both outputs of the port A and port B "L" (Step S25).

After a brake for a certain period described above, the controller 101 this time rotatably drives the motor 60 in the reverse direction by setting the output of the port A "L" and the output of the port B "H" (Step S26). Thus, the toner replenishment of the toner container 17C side is performed.

Then, when the controller 101 determines that the motor 60 was rotatably driven in the reverse direction for a certain period of time (for example, one second) (YES in Step S27), the controller 101 causes the rotation of the motor 60 to halt by setting both outputs of the port A and port B "L" (Step S28). The controller 101 maintains the state where the rotation of the motor 60 is halted (brake) for the above-described period of time by setting both outputs of the port A and port B "L" (Step S29).

After that, the process returns to Step S21. The controller 101 repeats the processes from S22 to S29 until the controller 101 determines that the toner replenishment for both of the toner M and toner C is not necessary (Step S21). The controller 101 terminates the process when the controller 101 determines that the toner replenishment for both of the toner M and toner C is not necessary (YES in Step S21).

As indicated in the first embodiment, for the prevention of toner fog, the controller 101 performs the intermittent control to the motor 60 and controls the container screw 112 of the specific toner container so as not to be rotatably driven. In this case, after the drive of the motor 60 for a certain period, a motor halt period of the above-described certain period occurs. In the second embodiment, with the use of the toner halt time, the toner replenishment mechanism 10 causes the motor 60 to be rotatably driven in the opposite direction, and performs the toner replenishment to the other toner container, which is a driving object. In view of this, in a time approximately similar to the necessary time to cause the toner replenishment to one toner container, which is the driving object, to be completed, the toner replenishment to the other toner container can be completed. Thus, according to the second embodiment, with respect to both of the two toner containers, which are the objects of toner replenishment by the toner replenishment mechanism 10, the toner replenishment can be substantially simultaneously performed by the toner replenishment mechanism 10.

Further, in the second embodiment, after the motor 60 is rotatably driven in one direction and by the time when the motor 60 is rotatably driven again in the opposite direction to the previous direction, the motor halt period of the above-described certain period of time is set. Thus, a flow of a through-current to the H-bridge circuit of the motor driver 70 can be prevented. Furthermore, when the rotation direction of the motor 60 is switched from one direction to the opposite direction, at the point the motor 60 attempts to continue rotation in the previous direction by inertia. In view of this, when the motor 60 is rotated in the opposite direction from this point, the load on the motor 60 increases. However, by the setting of the motor halt period of the above-described certain period of time, the motor 60 can be rotatably driven in the opposite direction after the rotation by the inertia is settled. Accordingly, the load to the motor 60 can be reduced.

Therefore, according to the second embodiment, the load to the motor 60 is reduced, and at the same time the toner replenishment can be substantially simultaneously performed by the toner replenishment mechanism 10 with respect to both of the two toner containers, which are the objects for the toner replenishment.

Additionally, the disclosure is not limited to the constitution of the above-described embodiments and can be variously modified. For example, in the above-described embodiments, the description is made with the use of the multifunctional peripheral as one embodiment of the image forming apparatus according to the disclosure. However, this is the only one example, and the other electronic devices, for example, the other image forming apparatus such as printer, copying machine, and facsimile device may be applicable.

Furthermore, a ratchet mechanism unit of a bearing type may be employed as the ratchet mechanism units 80A and 80B.

Additionally, in the above-described embodiments, the constitutions and processes illustrated by the above-described embodiments with the use of FIG. 1 to FIG. 5 are only one embodiment of the disclosure; and it is not meant to limit the disclosure to the constitutions and processes.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A toner replenishment mechanism, comprising:

a motor that includes a rotation shaft with a pinion;

a first ratchet mechanical unit that engages the pinion, the first ratchet mechanical unit transmitting only rotary drive power in a forward direction by the pinion to a driven mechanism disposed at a first toner replenishment unit, the first toner replenishment unit replenishing a first developer unit with a first color toner; and a second ratchet mechanical unit that engages the pinion, the second ratchet mechanical unit transmitting only rotary drive power in a reverse direction by the pinion to a driven mechanism disposed at a second toner replenishment unit, the second toner replenishment unit replenishing a second developer unit with a second color toner.

2. The toner replenishment mechanism according to claim 1, wherein the first ratchet mechanical unit transmits the rotary drive power in the forward direction by the pinion to the driven mechanism as a transport screw disposed to replenish the first developer unit with the first color toner, and the second ratchet mechanical unit transmits the rotary drive power in the reverse direction by the pinion to the driven mechanism as a transport screw disposed to replenish the second developer unit with the second color toner.

3. The toner replenishment mechanism according to claim 1, wherein the first ratchet mechanical unit transmits the rotary drive power in the forward direction by the pinion to the driven mechanism as a shutter member disposed in the first toner replenishment unit, the shutter member switching discharge/non-discharge of the first color toner to the first developer unit, and the second ratchet mechanical unit transmits the rotary drive power in the reverse direction by the pinion to the driven mechanism as a shutter member disposed in the second toner replenishment unit, the shutter member switching discharge/non-discharge of the second color toner to the second developer unit.

4. The toner replenishment mechanism according to claim 1, wherein the first ratchet mechanical unit transmits the rotary drive power in the forward direction by the pinion to a driven mechanism located inside the first toner replenishment unit as a first toner container, and the second ratchet mechanical unit transmits the rotary drive power in the reverse direction by the pinion to a driven mechanism located inside the second toner replenishment unit as a second toner container.

5. The toner replenishment mechanism according to claim 1, wherein the first ratchet mechanical unit transmits the rotary drive power in the forward direction by the pinion to a driven mechanism located inside the first toner replenishment unit as a first intermediate hopper, and the second ratchet mechanical unit transmits the rotary drive power in the reverse direction by the pinion to a driven mechanism located inside the second toner replenishment unit as a second intermediate hopper.

6. The toner replenishment mechanism according to claim 1, wherein the first and the second ratchet mechanical units each include a first member and a second member, the first member engaging the pinion of the motor for rotation, the second member engaging the first member for rotation in a direction perpendicular to an arranging direction of the first member and the pinion, the first member includes an engaging portion at a part opposed to the second member, the engaging portion having a shape projecting toward the second member, and the second member includes an engaging end portion and an inclined portion at a part opposed to the first member, the engaging end portion having a shape to abut on an engaging end portion of the engaging portion of the first member so as to transmit the rotary drive power in the forward direction, the inclined portion having an inclined shape not to abut on the engaging end portion of the first member so as to transmit the rotary drive power in the reverse direction.

7. The toner replenishment mechanism according to claim 6, wherein while the motor is rotatably driven in one direction, the control unit temporarily stops the motor at every constant period and then rotatably drives the motor again.

8. The toner replenishment mechanism according to claim 1, further comprising:

a motor driver that rotatably drives the motor; and a control unit that provides the motor driver with a control signal to perform an operation control for switching the rotation of the motor to the forward/reverse direction.

9. The toner replenishment mechanism according to claim 8, wherein the motor driver includes an H-bridge circuit.

10. The toner replenishment mechanism according to claim 9, wherein the control unit repeats a control where when the motor is rotatably driven in one direction, the control unit temporarily stops the motor at every constant period, after an elapse of a predetermined motor stop period, the control unit rotatably driving the motor in a reverse direction of a direction up to the time, after an elapse of the constant period and further an elapse of the motor stop period, the motor is rotatably driven in the one direction.

11. A method for controlling the toner replenishment mechanism according to claim 1, comprising:

executing a first rotary drive on the motor in one direction;

temporarily stopping the motor at every constant period, after an elapse of a predetermined motor stop period from the stop, executing a second rotary drive on the motor in a reverse direction of a direction up to the time;

after the rotary drive of the motor in the reverse direction, an elapse of the constant period and further an elapse of the motor stop period, executing a third rotary drive on the motor in the one direction; and repeating the first rotary drive to the third rotary drive until the first and the second toner replenishment units complete toner replenishment.

12. An image forming apparatus, comprising:

a first image carrier where an electrostatic latent image is formed on a surface;

a first developer unit that supplies the electrostatic latent image on the first image carrier with a first color toner;

a second image carrier where an electrostatic latent image is formed on a surface;

a second developer unit that supplies the electrostatic latent image on the second image carrier with a second color toner; and the toner replenishment mechanism according to claim 1.

13. A method for controlling toner replenishment, comprising:

preparing a first ratchet mechanical unit, the first ratchet mechanical unit engaging a pinion of a drive shaft of a motor, the first ratchet mechanical unit transmitting only rotary drive power in a forward direction by the pinion to a driven mechanism disposed at a first toner replenishment unit, the first toner replenishment unit replenishing a first developer unit with a first color toner;

preparing a second ratchet mechanical unit, the second ratchet mechanical unit engaging the pinion, the second ratchet mechanical unit transmitting only rotary drive power in a reverse direction by the pinion to a driven mechanism disposed at a second toner replenishment unit, the second toner replenishment unit replenishing a second developer unit with a second color toner; and controlling toner replenishment of two colors by the one motor using the first ratchet mechanical unit and the second ratchet mechanical unit.

* * * * *